US006779968B1

(12) United States Patent
Rietschle et al.

(10) Patent No.: US 6,779,968 B1
(45) Date of Patent: Aug. 24, 2004

(54) SIDE CHANNEL COMPRESSOR

(75) Inventors: Dieter Rietschle, Schopfheim (DE); Fritz-Martin Scholz, Hasel (DE); Markus Britsche, Efringen-Kirchen (DE); Oliver Mayer, Schopfheim (DE); Reinhard Garczorz, Lörrach (DE)

(73) Assignee: Werner Rietsche GmbH & Co., KG, Schopfheim (DE)

( * ) Notice: Subject to any disclaimer, the term of this patent is extended or adjusted under 35 U.S.C. 154(b) by 0 days.

(21) Appl. No.: 09/937,393

(22) PCT Filed: Mar. 26, 2000

(86) PCT No.: PCT/EP00/02624

§ 371 (c)(1),
(2), (4) Date: Jan. 3, 2002

(87) PCT Pub. No.: WO00/58629

PCT Pub. Date: Oct. 5, 2000

(30) Foreign Application Priority Data

Mar. 26, 1999 (DE) ..... 199 13 950

(51) Int. Cl.[7] ..... F04D 5/00
(52) U.S. Cl. ..... 415/55.1
(58) Field of Search ..... 415/55.1, 55.2, 415/55.3, 55.5, 55.6, 55.7; 417/423.2

(56) References Cited

U.S. PATENT DOCUMENTS 5,375,971 A * 12/1994 Yu ..... 415/55.1
5,527,149 A * 6/1996 Moss et al. ..... 415/55.1
5,819,524 A * 10/1998 Bosley et al. ..... 415/55.1 X
6,394,748 B1 * 5/2002 Rietschle et al. ..... 415/55.6

FOREIGN PATENT DOCUMENTS

| | | |
|---|---|---|
| DE | 876 285 C | 5/1953 |
| DE | 2 131 952 | 1/1973 |
| DE | 197 08 952 A1 | 3/1997 |
| EP | 0 602 558 A | 6/1994 |
| EP | 0 863 314 A | 9/1998 |
| GB | 606 127 A | 9/1948 |

OTHER PUBLICATIONS

"Side Channel Redesign" *Design Engineering, GB, Morgan–Grampian Ltd., London* (*Nov. 1, 1997*) pp. 10,11, Seite 15 XP000727481 (ISSN: 0308–8448).
*Copy* of German Office Action dated Mar. 31, 2000.
*Copy* of PCT International Search Report dated Jul. 3, 2000.

* cited by examiner

*Primary Examiner*—Edward K. Look
*Assistant Examiner*—Richard A. Edgar
(74) *Attorney, Agent, or Firm*—Stuart J. Friedman

(57) ABSTRACT

A side channel compressor comprises an inlet port (42) for gas and an outlet port (44) for compressed gas as well as a side channel (32) which provides a flow connection between the inlet port (42) and the outlet port (44), the cross-section of the side channel (32) diminishing between the inlet port (42) and the outlet port (44). The side channel (32) has at least one section in which it has a cross-section in the form of a half ellipse and in which the maximum depth of the channel (32) continuously diminishes towards the outlet port (44).

12 Claims, 4 Drawing Sheets

SIDE CHANNEL COMPRESSOR

FIELD OF THE INVENTION

The invention relates to a side channel compressor, comprising an inlet port for gas and an outlet port for compressed gas as well as a side channel which provides a flow connection between the inlet port and the outlet port, the cross-section of the side channel diminishing between the inlet port and the outlet port.

BACKGROUND OF THE INVENTION

Such a side channel compressor is known from DE 197 08 952 A1. In this side channel compressor, the cross-section of the side channel tapers continuously from the inlet port to the outlet port. The taper is intended to increase the efficiency of the side channel compressor, in that a constant raise in pressure in the side channel and an increase in the volume flow are produced. According to this prior art, the cross-section of the side channel is rectangular, but has rounded edges.

BRIEF SUMMARY OF THE INVENTION

It is the object of the invention to achieve a side channel compressor with an improved efficiency.

This is achieved in a side channel compressor of the type initially mentioned in that the side channel has at least one section in which it has a cross-section in the form of a half ellipse and in which the maximum depth of the channel continuously diminishes towards the outlet port.

In the side channel compressor according to the invention, the flow conditions in the side channel are optimized in that the transition points of the wall sections delimiting the cross-section are designed so as to be very smooth, so that transition points in the proper sense are not present. This is achieved by the elliptical shape of the channel. The gas flows from the blades of the compressor with an axial speed component, in relation to the blade axis, into the side channel and is deflected therein without leading to extreme losses. Thereby, a higher volume flow and a higher output of the compressor are achieved. Due to the slanted portions associated with an elliptical design, the latter results in a better producibility of the channel by means of casting in sand or diecasting methods.

The section of the side channel with elliptical cross-section may extend along the entire length of the side channel, or only along a part of it. The section with elliptical cross-section should begin at the latest at approximately half the distance of the flow path between the inlet port and the outlet port. It is in this region, namely, that the gas to be compressed has experienced a substantial compression already, to which the cross-section should be adapted by it being reduced.

The section with elliptical cross-section should end in the region of the outlet port, where also the highest compression exists.

It is to be emphasized that the optimum output of the compressor can only be achieved by adapting the diminution of the cross-section of the side channel to the type of gas and the capacity of the compressor, in particular the speed of it. It is, for instance, not optimum if the cross-section diminishes extremely high or too less, because the gas flow is blocked in the first case and in the second case the compressibility of the gas is not fully made use of. The cross-sectional area of the side channel in the section with elliptical cross-section is, according to the preferred embodiment, adapted to the ratio of the increase in density of the gas, by the cross-sectional area being correspondingly reduced. An optimum diminution of the cross-sectional area is produced on the assumption of an approximately adiabatically isentropic compression of the gas to be compressed, the cross-sectional area being reduced corresponding to the diminishing volume of gas.

This course is calculated as follows, with index 1 marking the specific quantities at the inlet and index 2 the specific quantities at the outlet of the side channel.

For the course of compression along the side channel there is true:

$$m_1=m_2=\text{const.}$$

With the ideal gas equation: pV=m RT follows $$\frac{P_1V_1}{T_1}=\frac{P_2V_2}{T_2}$$

or $$V_2=V_1\cdot\frac{P_1}{P_2}\cdot\frac{T_2}{T_1}.$$

With the additional condition $\overline{C_1}=\overline{C_2}=$ const. one obtains:

$$A_2=A_1\cdot\frac{P_1}{P_2}\cdot\frac{T_2}{T_1}.$$

For an adiabatically isentropic compression and on the assumption:

$$\chi=1{,}4$$

$$\Delta p=200\text{ mbar}$$

$$P_1=970\text{ mbar}$$

$$T_1=20^\circ\text{ C.}$$

there is true:

$$T_2=T_1\cdot\left(\frac{P_2}{P_1}\right)^{\frac{x-1}{x}}$$

$$T_1=(20+273)\text{K}=293\text{ K.}$$

For pressure operation follows:

$$T_2^D=293\text{ K}\cdot\left(\frac{200+970}{970}\right)^{\frac{0.4}{1.4}}=309\text{ K.}$$

For suction operation follows:

$$T_2^V=293\text{ K}\cdot\left(\frac{970}{770}\right)^{\frac{0.4}{1.4}}=312\text{ K.}$$

From that follows, in pressure operation, a cross-sectional ratio of the channel between outlet and inlet port:

$$\frac{A2}{A1} = \frac{P1}{P2} \cdot \frac{T2}{T1} = \frac{970}{970+200} \cdot \frac{390}{293} = 87\%$$

and in suction operation a cross-sectional ratio:

$$\frac{A2}{A1} = \frac{970-200}{970} \cdot \frac{312}{293} = 85\%$$

With the above formulas, the optimum cross-sectional areas at any desired place of the channel can be determined.

The optimization of the course of the taper of the cross-sectional area along the length of the side channel on the assumption of an adiabatically isentropic compression is not necessarily limited to the elliptical cross-sectional shape of the channel. Rather, this corresponding diminution of the cross-section may also result in an optimization of the efficiency with other channel shapes.

There may be conceivable other constitutional changes of gas in a side channel compressor, for instance an isothermal compression, but the adiabatically isentropic compression has proved to be successful in this context for achieving a high efficiency.

A further design of the invention provides for that the side channel has a semicircular cross-section before the section with elliptical cross-section. This semicircular cross-section changes steadily into an ellipse becoming more and more shallow, with preferably the main axis of the ellipse lying substantially in the flat surface of that cover of the side channel compressor which comprises the side channel.

For reasons in terms of fluid technics, it may be an advantage if the main axis of the ellipse lies slightly inwardly of the cover of the side channel compressor which comprises the side channel.

The width of the side channel should preferably remain constant along its entire length, so that the diminution of the cross-section is effected exclusively by the diminished depth, but with the shape of the ellipse adapted.

According to one design of the invention, the side channel runs, as seen in a side view, in the shape of a horse shoe, so that a large length of the side channel is produced. Prolongations at the ends of the channel constitute the inlet and outlet ports, respectively.

The side channel compressor according to the invention may be configured one-stage or multi-stage, the cross-sectional area of the inlet port of a succeeding stage preferably corresponding to the cross-sectional area of the outlet port of the directly preceding stage. With this, it is to be prevented that the gas experiences a constitutional change in the channel between successive stages.

Preferably, the individual stages are all provided with a side channel as defined above, i.e. with a continuously diminishing cross-sectional area between inlet port and outlet port. As the pressure profile in a multi-stage compressor differs from that of a single-stage compressor, the diminution of the cross-sectional area has, of course, to be adapted to this effect. So there would be necessary for each stage in the two-stage compressor—with equal raise in pressure between inlet and outlet of a two-stage and a single-stage compressor—only half of the channel taper as compared with the single-stage compressor.

BRIEF DESCRIPTION OF THE DRAWINGS

Further features and advantages of the invention will be apparent from the following description and the following drawings to which reference is made and in which.

DESCRIPTION OF THE PREFERRED EMBODIMENT

Figure 1:
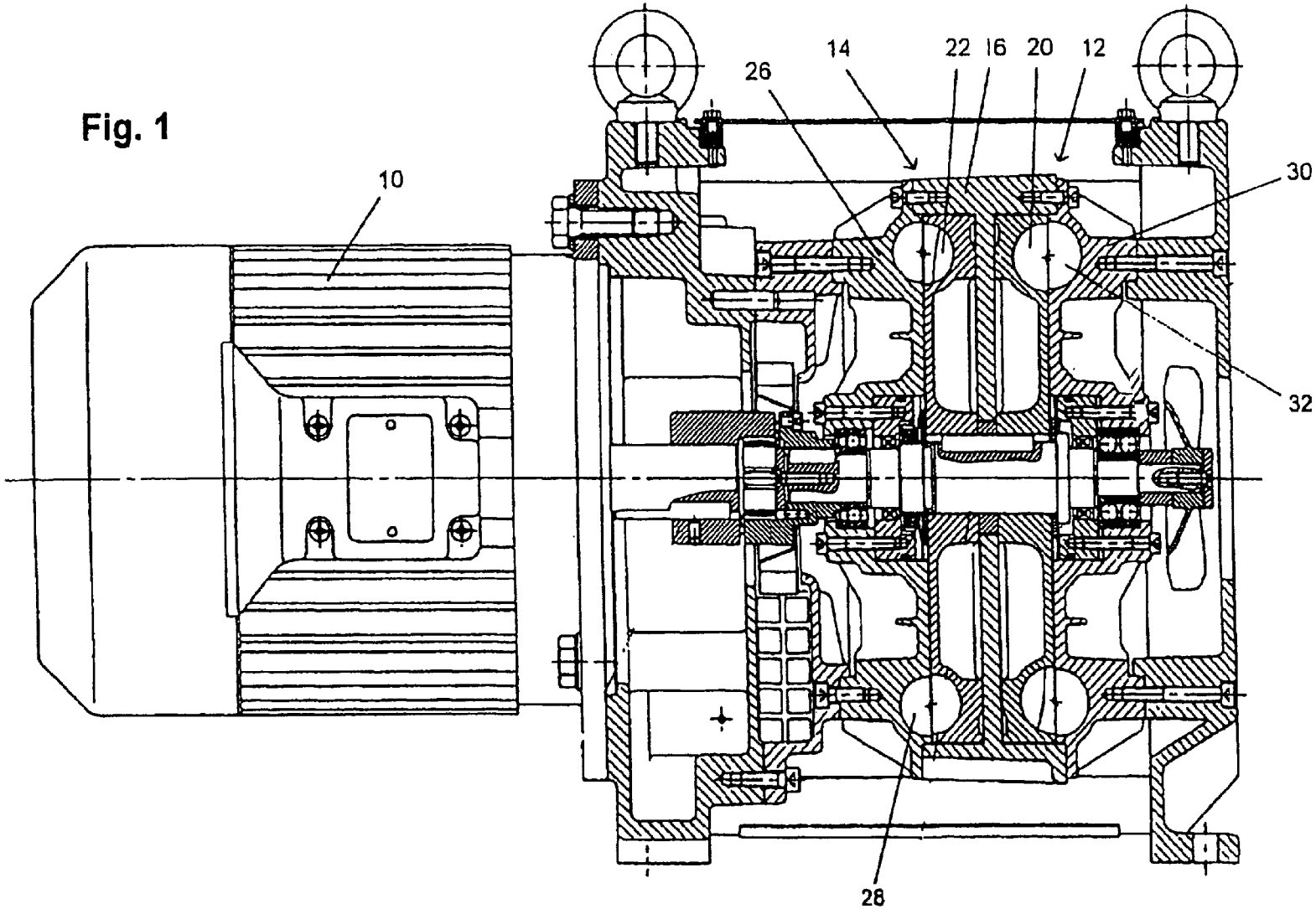
FIG. 1 shows a longitudinal sectional view through a two-stage side channel compressor according to the invention.

In the side channel compressor shown in FIG. 1, a drive motor 10, a first stage 12 and a second stage 14 are integrated in an assembly unit. A housing is referenced by 16. Blades 20, 22 of the stages 12 and 14, respectively, are mounted on a drive shaft, which in turn is made to rotate by the drive motor 10. A first housing cover 30, screwed to the housing 16, comprises a side channel 32 of the first stage. On the opposite side, there is connected with the housing 16 a second housing cover 26 which comprises a side channel 28. The first stage 12 has inlet and outlet ports which will be explained by means of FIG. 2. The outlet port of the first stage is connected with the inlet port of the second stage 14 by means of a channel (not shown) in the housing. The channel as well as the cross-sections of the outlet port of the first and the inlet port of the second stage are designed such that there is no change in cross-section between the first and the second stage in the region of the channel.

Figure 2:
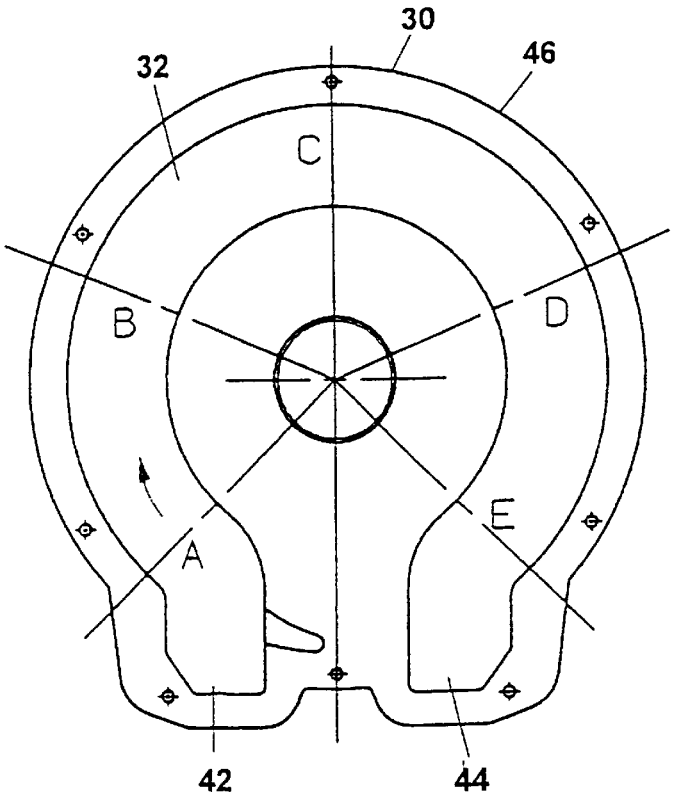
FIG. 2 shows a side view of a cover illustrated in FIG. 1, having a side channel.

The housing cover 30 is illustrated isolated in FIG. 2. The side channel 32 formed therein is substantially of a horse-shoe shape and has a section in the shape of a circular arc and extending along 270° (reaching from sectional line A to sectional line E). An inlet port 42 upstream of the sectional line A extends along approximately 15° and forms a type of prolongation of the side channel 32. Downstream of the sectional line E, there is likewise provided a prolongation-like outlet port 44.

Figure 3:
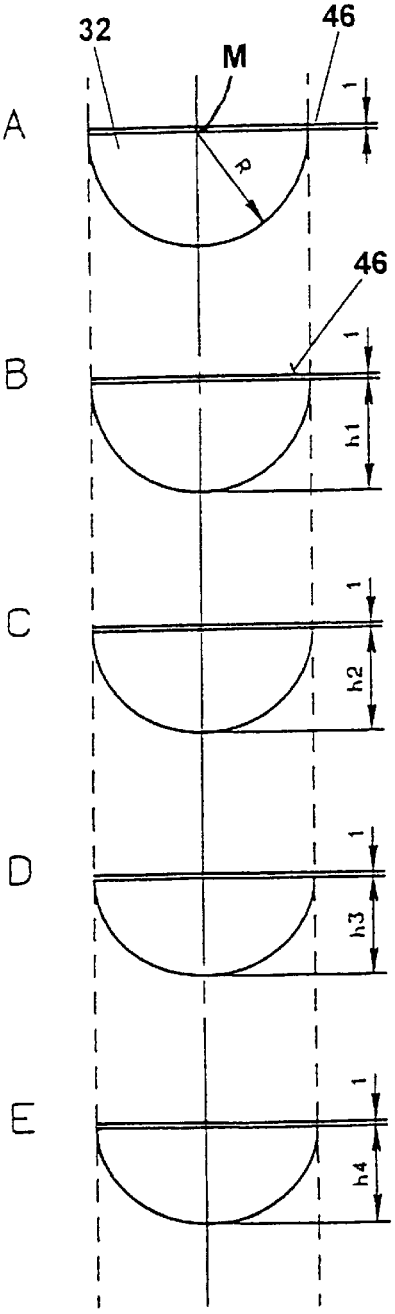
FIG. 3 shows successive cross-sections of the side channel along the sectional lines A, B, C D and E which are illustrated in FIG. 2.

The side channel 32 has the same width from sectional line A to sectional line E, as can also be seen by means of the sectional sequence in FIG. 3, which only shows the side channel itself. At the beginning, at the sectional line A, the side channel has still a semicircular cross-section, the center of the semicircle even lying slightly below the flat surface 46 of the cover 30, starting from which the side channel extends into the interior of the cover. In FIG. 3, 1 mm is given as the distance of the surface 46 from center M. From the inlet port 42 to the outlet port 44 there arises a main flow direction which is illustrated by an arrow in FIG. 2. As can be taken from FIG. 3, the cross-sectional area of the side channel 32 is continuously reduced on this way up to the outlet port 44. The section of the side channel 32 from the sectional line A to the sectional line E forms a section with an elliptical side channel cross-section. The cross-section of the side channel 32 changes from a semicircle at the sectional line A to an ellipse with a more and more decreasing depth. The depth at the sectional line B is illustrated by h1, at the sectional line C by h2, at the sectional D by h3 and at the sectional line E by h4. The half of the ellipse defining the side channel is, as it were, compressed with the length of the flow path increasing. The diminution of the cross-sectional area is adapted to the specific volume, which is continually reduced along the flow path, of the gas to be compressed on the assumption of an adiabatically isentropic constitutional change. Thereby, the efficiency of the side channel compressor is optimized.

As can be seen by means of the sectional sequences according to the sectional lines B to E, the main axis of the ellipse likewise lies within the cover by approximately 1 mm.

The cross-section of the side channel 32, which changes steadily and continuously from a semicircle to an increasingly shallow ellipse, is distinguished by excellent flow conditions in the side channel 32, because only small flow losses occur. The efficiency of the side channel compressor is so high, because, as already mentioned, the course of the cross-section is adapted to the constitutional change of the compressed gas.

Figure 5:
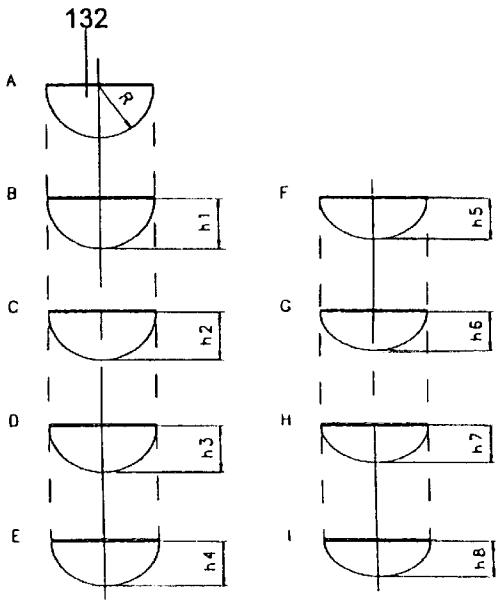
FIG. 5 shows successive cross-sections of the side channel along the sectional lines A–I illustrated in FIG. 4.
Figure 4:
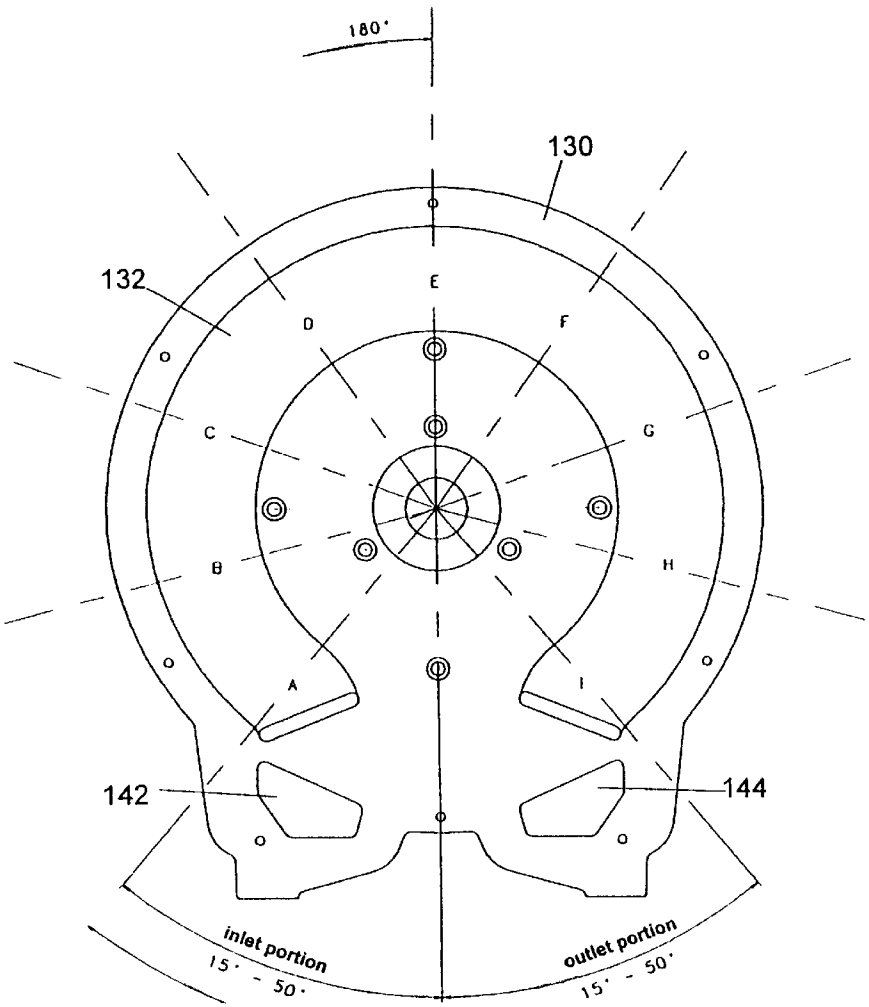
FIG. 4 shows a side view of a slightly modified cover having a modified side channel.

In FIGS. 4 and 5 there is shown a slightly modified housing cover 130 in which the side channel 132 has a somewhat differently designed inlet- and outlet region. The inlet region extends across 15° to 50°, just like the outlet region. Reference numeral 142 designates the inlet port of the first stage and 144 the outlet port of the first stage, which leads to the inlet port of the second stage.

In FIG. 5 there is to be seen by means of the sectional sequence that the side channel 132 alters from a circular cross-section to an increasingly shallow elliptical cross-section.

The second stage 14 has a side channel, which is likewise tapered along its entire length. This side channel, too, begins with a semicircular cross-section, this cross-section, however, having a surface area which corresponds to the surface area of the side channel at the outlet opening 44 with the elliptical cross-section. The side channel of the second stage then continuously changes to an increasingly shallow ellipse, as is correspondingly illustrated in FIGS. 2 to 5.

Figure 6:
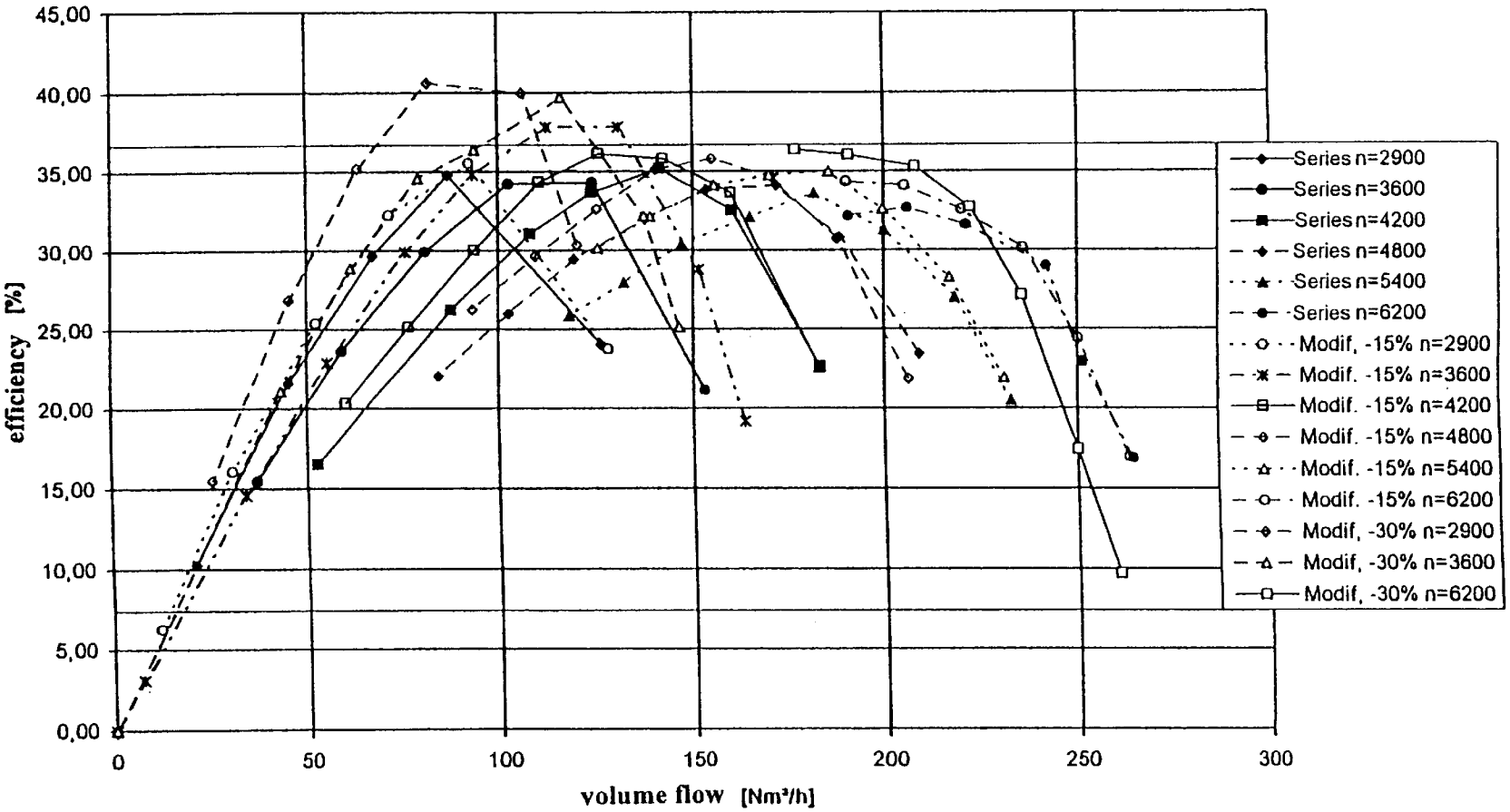
FIG. 6 shows various courses of the efficiency at differing speeds of side channel compressors without, with a 15% taper of cross-section and with a 30% taper of cross-section.

FIG. 6 shows the raise of the efficiency achievable by the diminution of the side channel cross-section. Three different side channel compressors have been employed for the courses illustrated, which were measured at different speeds. A side channel compressor referenced by "Series" has a semicircular cross-section without any taper. A modified side channel compressor according to the invention with an elliptical cross-section has a diminution of cross-section of 15% between inlet port and outlet port and a further compressor a diminution in cross-section of 30%. It is not only shown by FIG. 6 that a significant raise in efficiency can be achieved, but additionally that this raise in efficiency strongly depends on the speed. As has been explained above, a diminution in cross-section by e.g. 15% can not generally lead to an enormous raise in efficiency at differing speeds. Rather, the diminution in cross-section is to be adapted to the constitutional change of the gas which in turn depends on the geometric conditions in the side channel and in the blade wheel as well as on the volume flow and, hence, the speed. With this, it really may happen that at specific speeds and specific geometries of the blade wheel together with the blades, substantially smaller or substantially higher diminutions in cross-section have to be carried out, in order to achieve an optimum raise in efficiency.

What is claimed is:

1. A side channel compressor, comprising an inlet port (42; 142) for gas and an outlet port (44; 144) for compressed gas as well as a side channel (32; 132) which provides a flow connection between the inlet port (42; 142) and the outlet port (44; 144), the cross-section of the side channel (32; 132) diminishing between the inlet port (42; 142) and the outlet port (44; 144), and the side channel (32; 132) having at least one section in which it has a cross-section in the form of a half ellipse and in which the maximum depth of the channel (32; 132) continuously diminishes towards the outlet port (44; 144), wherein the main axis of the ellipse defining the cross-section lies slightly inwardly of the cover (26, 30) of the side channel compressor along the whole channel section having an elliptical cross-section, which cover comprises the side channel (32; 132).

2. The side channel compressor according to claim 1, wherein the section with elliptical cross-section ends in die region of the outlet port (44; 144).

3. The side channel compressor according to claim 2, wherein the section with elliptical cross-section begins at the latest at half of the distance of the flow path between the inlet port (42; 142) and the outlet port (44; 144).

4. The side channel compressor according to claim 1, wherein the section with elliptical cross-section begins at the latest at half of the distance of the flow path between the inlet port (42; 142) and the outlet port (44; 144).

5. The side channel compressor according to claim 1, wherein the width of the side channel (32; 132) remains constant along its entire length.

6. The side channel compressor according to claim 1, wherein the cross-sectional area of the side channel (32; 132) is continually reduced in the section with elliptical cross-section, corresponding to the ratio of the increase in density of the gas.

7. The side channel compressor according to claim 1, wherein the side channel (32; 132) runs, as seen in a side view, substantially in the shape of a horse shoe.

8. The side channel compressor according to claim 1, wherein the compressor is configured multi-stage and the cross-sectional area of the inlet port of a succeeding stage corresponds to the cross-sectional area of the outlet port (44; 144) of the directly preceding stage.

9. A side channel compressor, comprising an inlet port (42; 142) for gas and an outlet port (44; 144) for compressed gas as well as a side channel (32; 132) which provides a flow connection between the inlet port (42; 142) and the outlet port (44; 144), the cross-section of the side channel (32; 132) diminishing between the inlet part (42; 142) and the outlet part (44; 144), and the side channel (32; 132) having at least one section in which it has a cross-section in the form of a half ellipse and in which the maximum depth of the channel (32; 132) continuously diminished towards the outlet port (44; 144), wherein the main axis of the ellipse defining the cross-section lies slightly inwardly of the cover (26, 30) of the side channel compressor which cover comprises the side channel (32; 132) and wherein the side channel (32; 132) has a semicircular cross-section before the section with elliptical cross-section.

10. A side channel compressor, comprising an inlet port (42; 142) for gas and an outlet port (44; 144) for compressed gas a housing (16), a cover (26, 30) having a flat surface (46) adjacent to the housing (16) as well as a side channel (32; 132) arranged in the cover (26, 30) and providing a flow connection between the inlet port (42; 142) and the outlet port (44; 144), the cross-section of the side channel (32; 132) diminishing between the inlet port (42; 142) and the outlet port (44; 144), and the side channel (32; 132) having at least one section in which it has a cross-section in the form of a half ellipse and in which the maximum depth of the channel (32; 132) continuously diminished towards the outlet port (44; 144), wherein the main axis of the ellipse defining the cross-section lies parallel to the flat surface (46) and slightly inwardly of the cover (26, 30).

11. A side channel compressor, comprising an inlet port (42; 142) for gas and an outlet port (44; 144) for compressed gas a housing (16), a cover (26, 30) having a flat surface (46) adjacent to the housing (16) as well as a side channel (32; 132) arranged in the cover (26, 30) and providing a flow connection between the inlet port (42; 142) and the outlet port (44; 144), the side channel (32; 132) having at least one section in which it has a cross-section in the form of a half ellipse and in which the maximum depth of the channel (32; 132) continuously diminished towards the outlet port (44; 144), wherein the main axis of the ellipse defining the cross-section lies slightly inwardly of the cover (26, 30) and at a constant distance from the flat surface along the side channel (32; 132) between the inlet port (42; 142) and the outlet port (44; 144).

12. A side channel compressor, comprising an inlet port (42; 142) for gas and an outlet port (44; 144) for compressed gas as well as a side channel (32; 132) which provides a flow connection between the inlet port (42; 142) and the outlet port (44; 144), the cross-section of the side channel (32; 132) diminishing between the inlet port (42; 142) and the outlet port (44; 144), and the side channel (32; 132) having at least one section in which it has a cross-section in the form of a half ellipse and in which the maximum depth of the channel (32; 132) continuously diminished towards the outlet port (44; 144), wherein the main axis of the ellipse defining the cross-section lies slightly inwardly of the cover (26, 30) of the side channel compressor which cover comprises the side channel (32; 132), wherein the cross-sectional area of the side channel (32; 132) is continually reduced in the section with elliptical cross-section, corresponding to the diminishing volume of gas and on the assumption of an approximately adiabatically isentropic compression of the gas to be compressed.

* * * * *

UNITED STATES PATENT AND TRADEMARK OFFICE

CERTIFICATE OF CORRECTION

PATENT NO. : 6,779,968 B1
DATED : August 24, 2004
INVENTOR(S) : Dieter Rietschle et al.

It is certified that error appears in the above-identified patent and that said Letters Patent is hereby corrected as shown below:

Title page,
Item [22], PCT Filed , delete "Mar. 26, 2000" and substitute -- Mar. 24, 2000 --.

Signed and Sealed this

Ninth Day of November, 2004

JON W. DUDAS
*Director of the United States Patent and Trademark Office*